US006604587B1

(12) United States Patent
Singh et al.

(10) Patent No.: US 6,604,587 B1
(45) Date of Patent: Aug. 12, 2003

(54) FLAT PROFILE CUTTING STRUCTURE FOR ROLLER CONE DRILL BITS

(75) Inventors: Amardeep Singh, Houston, TX (US); Sujian Huang, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/593,690

(22) Filed: Jun. 14, 2000

(51) Int. Cl.[7] ..... E21B 10/08
(52) U.S. Cl. ..... 175/331; 175/374
(58) Field of Search ..... 175/331, 341, 175/374, 383, 420.1, 420.2, 424, 434

(56) References Cited

U.S. PATENT DOCUMENTS

| | | | | |
|---|---|---|---|---|
| 4,231,438 A | * | 11/1980 | Garner et al. | 175/353 |
| 4,408,671 A | | 10/1983 | Munson | 175/377 |
| 4,611,673 A | | 9/1986 | Childers et al. | 175/340 |
| 4,641,718 A | * | 2/1987 | Bengtsson | 175/331 |
| 4,657,093 A | | 4/1987 | Schumacher | 175/353 |
| 4,848,476 A | | 7/1989 | Deane et al. | 175/340 |
| 5,145,016 A | | 9/1992 | Estes | 175/331 |
| 5,372,210 A | | 12/1994 | Harrell | 175/431 |
| 5,394,952 A | | 3/1995 | Johns et al. | 175/332 |
| 5,813,480 A | | 9/1998 | Zaleski, Jr. et al. | 175/40 |
| 6,057,784 A | | 5/2000 | Schaaf et al. | 340/854.4 |
| 6,095,262 A | | 8/2000 | Chen | 175/57 |
| 6,170,583 B1 | * | 1/2001 | Boyce | 175/426 |
| 6,213,225 B1 | | 4/2001 | Chen | 175/57 |
| 6,401,839 B1 | | 6/2002 | Chen | 175/57 |
| 6,412,577 B1 | | 7/2002 | Chen | 175/57 |

FOREIGN PATENT DOCUMENTS

| | | |
|---|---|---|
| GB | 807190 | 1/1959 |
| GB | 845355 | 4/1959 |
| GB | 1088860 | 10/1967 |
| GB | 2132662 | 7/1984 |
| WO | WO 00/12859 | 3/2000 |
| WO | WO 00/12860 | 3/2000 |

OTHER PUBLICATIONS

Great Britain Search Report, Dated Aug. 7, 2002, 1 page.
Ma Dekun et al., "The Operational Mechanics of The Rock Bit", Petroleum Industry Press, 1996, pp. 1–243.
Society of Petroleum Engineers Paper No. 29922, "The Computer Simulation of the Interaction Between Roller Bit and Rock", Dekun Ma, et al, presented Nov. 14–17, 1995, 9 pages.
Society of Petroleum Engineers Paper No. 56439, "Field Investigation of the Effects of Stick–Slip, Lateral, and Whirl Vibrations on Roller Cone Bit Performance", S. L. Chen et al, presented Oct. 3–6, 1999, 10 pages.
Society of Petroleum Engineers Paper No. 71053, "Development and Application of a New Roller Cone Bit with Optimized Tooth Orientation", S. L. Chen et al., presented May 21–23, 2001, 15 pages.
Society of Petroleum Engineers Paper No. 71393, "Development and Field Applications of Roller Cone Bits with Balanced Cutting Structure", S. L. Chen et al., presented Sep. 30–Oct. 3, 2001, 11 pages.

* cited by examiner

*Primary Examiner*—David Bagnell
*Assistant Examiner*—Jennifer R. Dougherty
(74) *Attorney, Agent, or Firm*—Rosenthal & Osha L.L.P.

(57) ABSTRACT

A drill bit including a roller cone and a plurality of cutting elements. The roller cone is affixed to a bit body and is arranged circumferentially about a bit axis of rotation. In one aspect, the cutting elements are arranged so that the crests of at least half of the cutting elements are within about 10 degrees of perpendicularity to the bit axis when each of these cutting elements is in a downwardmost rotary orientation. In another aspect, the roller cone and the cutting elements are arranged so that crests on the cutting elements define a substantially flat profile. Substantially flat in this aspect includes the profile having an endmost angle, either at the gage side or the centerline side, with respect to perpendicular to the bit axis, of less than about 11 degrees.

56 Claims, 5 Drawing Sheets

FLAT PROFILE CUTTING STRUCTURE FOR ROLLER CONE DRILL BITS

BACKGROUND OF THE INVENTION

1. Technical Field

The invention relates generally to roller cone drill bits. Particularly, the invention provides new flat profile cutting element geometries for roller cone bits.

2. Background Art

Roller cone drill bits are commonly used in the oil and gas industry for drilling wells. FIG. 1 shows one example of a roller cone drill bit used in a conventional drilling system for drilling a well bore in an earth formation. The drilling system includes a drilling rig 10 used to turn a drill string 12 which extends downward into a wellbore 14. Connected to the end of the drill string 12 is a roller cone-type drill bit 20.

As shown in FIG. 2, roller cone bits 20 typically comprise a bit body 22 having an externally threaded connection at one end 24, and a plurality of roller cones 26 (usually three as shown) attached at the other end of the bit body 22 and able to rotate with respect to the bit body 22. Disposed on each of the cones 26 of the bit 20 are a plurality of cutting elements 28 typically arranged in rows about the surface of the cones 26. The cutting elements 28 can be tungsten carbide inserts, polycrystalline diamond inserts, boron nitride inserts, or milled steel teeth. If the cutting elements 28 are milled steel teeth, the teeth may be coated with a hardfacing material.

Prior art roller cone bits generally have cutting elements arranged so that they contact a formation in an arcuate cross section or "profile." An example of such a prior art bit is shown in FIG. 3A. FIG. 3A shows a cross section through roller cones 30 of a drill bit 31. The cross sectional view shows a cutting element profile 36 generated when cross sections of all the cones 30 of the bit 31 are rotated into the same plane. In FIG. 3A, the roller cones 30 are rotatably attached to legs 32 of the drill bit 31. The cutting elements 34 are arranged about the surface of the roller cones 30. The cutting elements 34 in contact with the bottom of the drilled hole are further illustrated in FIG. 3B.

FIGS. 3A and 3B show that prior art bits generally have cutting elements 40–43 arranged in an arcuate cutting element profile 36 so that the bit 31 drills a wellbore with a similarly arcuate, rounded bottom hole profile (38 in FIG. 3B). The cutting element profile 36 is defined as a curve or line that connects crests 33 of the cutting elements 40–43 and that defines the relative shape of the bottom of the hole drilled by the cones 30. The cutting element profile 36 may be further defined by angular measurements taken at points (such as points A, B, and C in FIG. 3A) along the profile 36. Points A, B, and C are located at midpoints of crests 33, and angular measurements are defined relative to a horizontal plane (not shown). In FIG. 3A, point A is located at the midpoint of a gage cutting element and point C is located at the midpoint of a centerline cutting element. The angular measurements with respect to the horizontal plane at points A, B, and C are 17.5 degrees, 0 degrees, and 14.0 degrees, respectively.

FIG. 3B shows a planar cross sectional view similar to FIG. 3A. FIG. 3B also shows that the cutting elements of prior art bits typically have crests 44 and 45 that are disposed at various angles with respect to a bit axis of rotation 46 when the cutting elements 40–43 are drilling the formation 39. Therefore, when prior art bits contact the formation with arcuate profiles and at the angles defined by the crests of the cutting elements, the contact between the cutting elements and the formation is generally non-uniform.

BRIEF SUMMARY OF THE INVENTION

The invention is a drill bit that includes a roller cone and a plurality of cutting elements. The roller cone is affixed to a bit body-and is arranged circumferentially about an axis of rotation of the bit.

One aspect of the invention includes cutting elements that are arranged so that the crests of at least half the cutting elements are substantially perpendicular to the bit axis of rotation when the cutting elements are in a downwardmost rotary orientation. In one embodiment, the crests are within about 10 degrees of perpendicular to the axis of rotation. In another embodiment, the crests are within about 5 degrees of perpendicular to the axis. In a particular embodiment, substantially all the crests are within about 10 degrees of perpendicularity to the bit axis.

In another aspect of the invention, the roller cone and the cutting elements are arranged so that the crests on the cutting elements define a substantially flat profile. Substantially flat includes profile angles, with respect to perpendicular to the bit axis, at either the gage edge of the bit or at the bit centerline of 11 degrees or less.

Other aspects and advantages of the invention will be apparent from the following description and the appended claims.

DETAILED DESCRIPTION

Figure 4A:
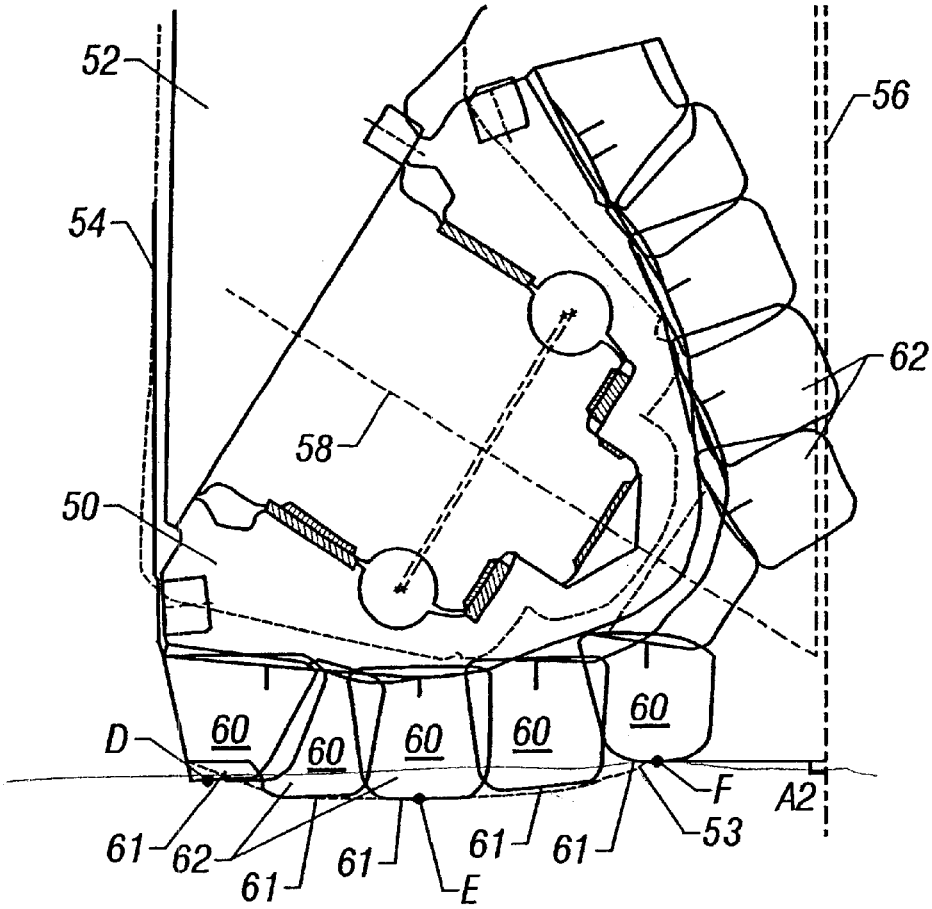
FIG. 4A shows a cross sectional view of an embodiment of the invention in which cross sections of all of the cones are rotated into the same plane.

FIG. 4A shows a cross section through roller cones 50 of a drill bit 54. The cross sectional view shows a cutting element profile 53 generated when cross sections of all the cones 50 of the bit 54 are rotated into the same plane. FIG. 4A shows cones 50 rotatably attached to legs 52 of a bit body of a drill bit 54. The roller cones 50 are attached to legs 52 by means known in the art, and the roller cones 50 are rotatable about a roller cone axis of rotation 58. The bit 54 is rotated about a bit axis of rotation 56 to drill rock. The roller cones 50 have a plurality of cutting elements 62 disposed about the circumference of the cones 50. The cutting elements 62 are generally arranged in rows 60. The rows 60 are typically oriented to form "rings" at selected positions along the cone axis of rotation 58. The cutting elements 62 may be arranged on the roller cones 50 so that cutting elements 62 on adjacent rows 60 are aligned, staggered, or otherwise positioned, and still perform the essential function of the invention. The cutting elements 62 can be tungsten carbide inserts, polycrystalline diamond inserts, boron nitride inserts, or milled steel teeth. If the cutting elements 62 are milled steel teeth, the teeth may be coated with a hardfacing material. If the cutting elements 62 are tungsten carbide inserts, they may be coated with a superhard material.

The cutting elements 62 have crests 61. The crests 61 are oriented so that an angle A2 defined between a line parallel to the crest 61, and the bit axis of rotation 56 is approximately 90 degrees. The near perpendicular relationship between the crests 61 and the bit axis 56 brings substantially all of the crest of each of the cutting elements 62 that are in their downwardmost rotary orientations into contact with the formation (not shown) when drilling a wellbore. A cutting element 62 is at its downwardmost rotary orientation when the roller cone 50 is oriented, relative to the roller cone axis 58, so that the cutting element 62 is proximate the bottom of the wellbore. In this aspect of the invention, at least half of the cutting elements 62 have crests 61 that are substantially perpendicular to the bit axis of rotation 56. In a particular embodiment of this aspect of the invention, substantially all of the cutting elements 62 have crests 61 that are substantially perpendicular to the bit axis of rotation 56.

The embodiment shown in FIG. 4A includes the crests 61 oriented exactly perpendicular, that is, zero degrees out of perpendicularity with respect to the axis 56. This aspect of the invention, however, will provide substantially improved performance as compared to prior art bits where the crests 61 are oriented within about 10 degrees or less of perpendicular to the axis 56. Having the crests 61 out of perpendicularity by within about 10 degrees is therefore within the scope of this invention. More preferably, the crests 61 are oriented within about 5 degrees or less of perpendicular to the axis 56. Most preferably, the crests 61 are oriented as shown in FIG. 4A being substantially perpendicular to the axis 56.

Figure 1:
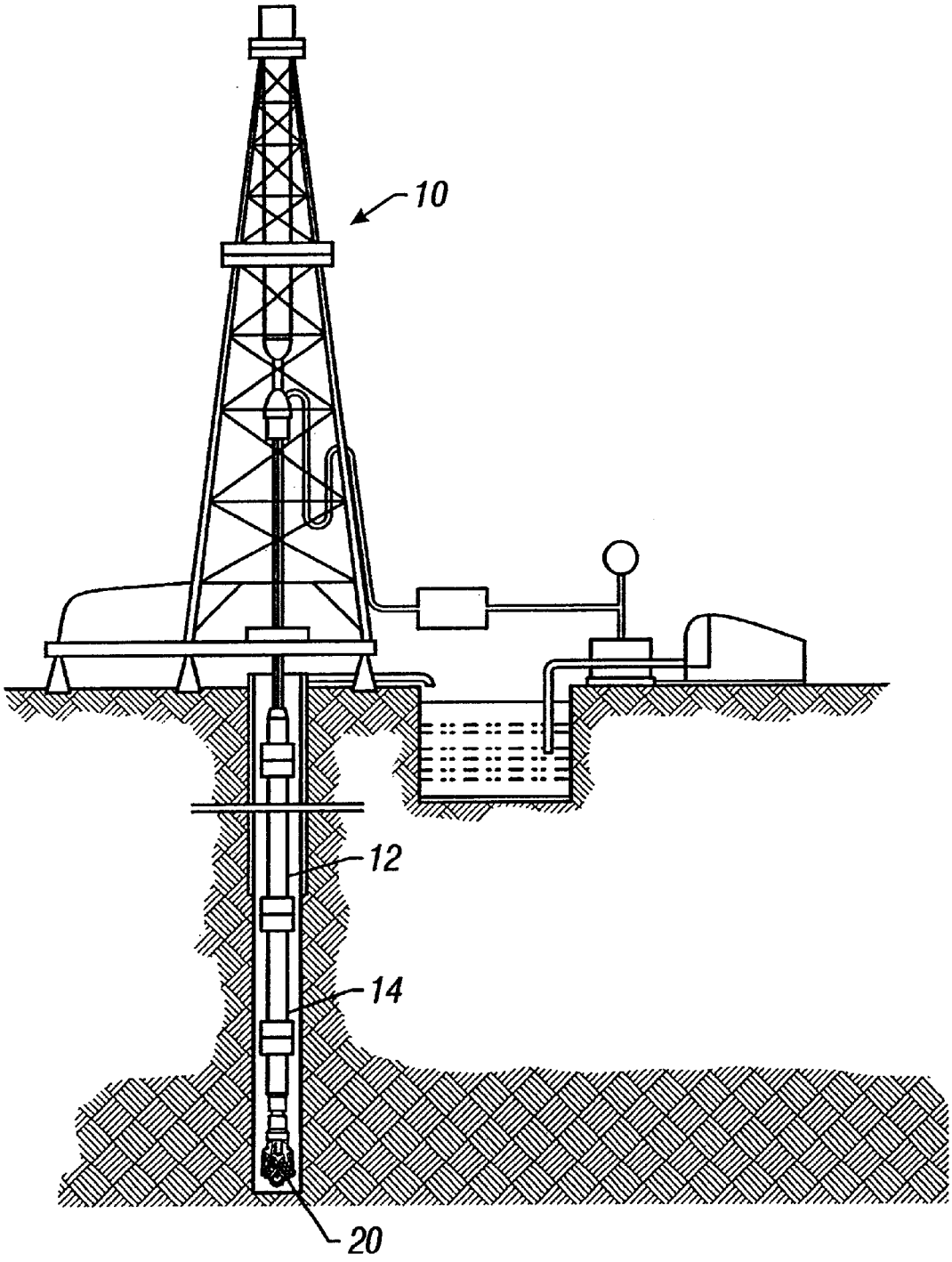
FIG. 1 (Prior Art)
FIG. 1 shows a schematic of a drilling system for drilling a formation that includes a drill string with a roller cone bit.
Figure 2:
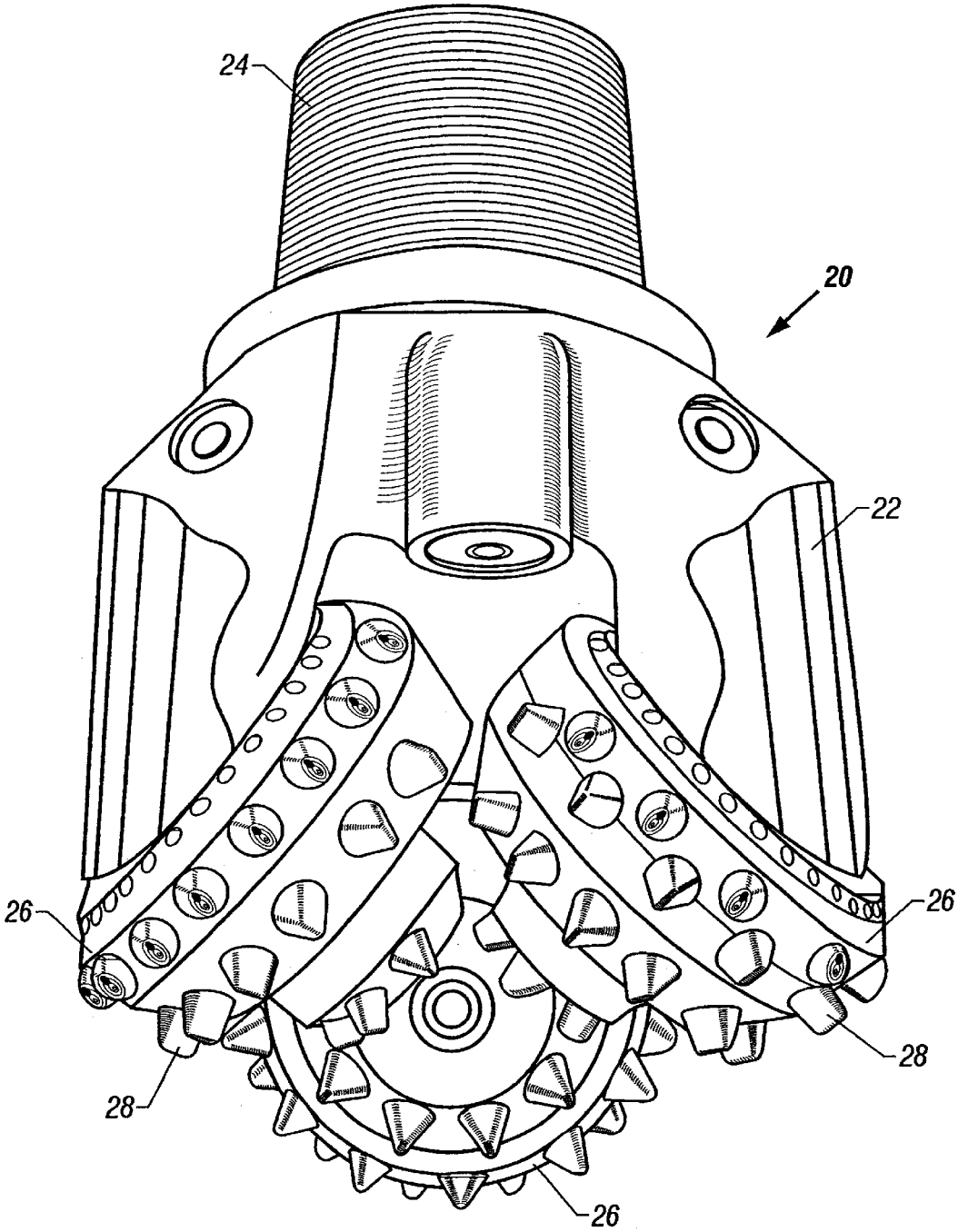
FIG. 2 (Prior Art)
FIG. 2 shows a perspective view of a prior art roller cone drill bit.
Figure 3A:
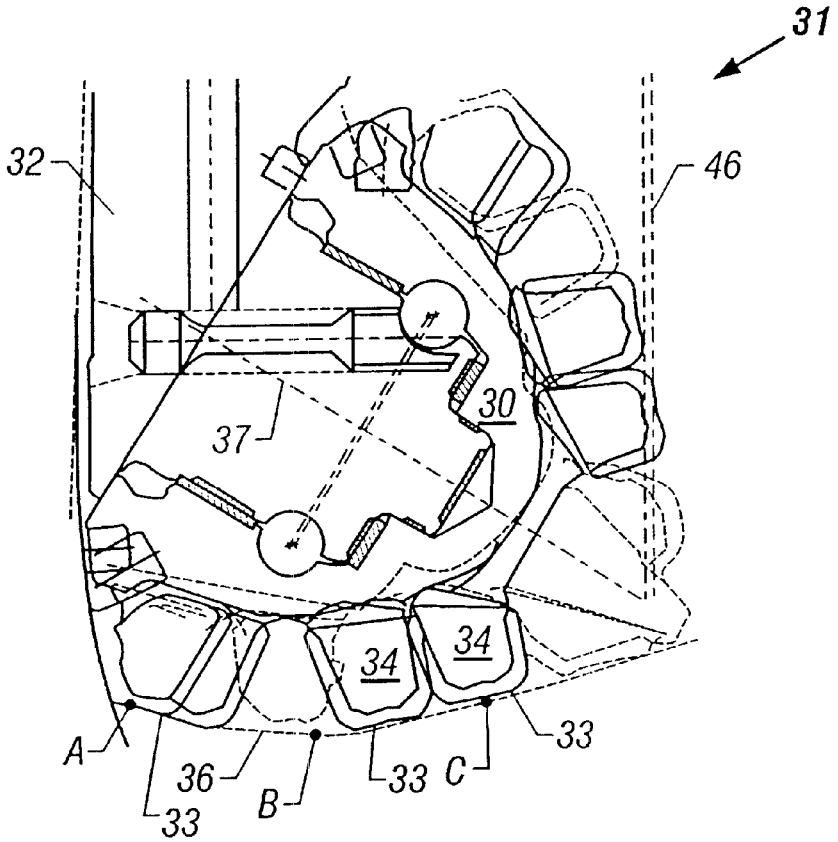
FIG. 3A Prior Art
FIG. 3A shows a cross sectional view of the cones of a prior art roller cone bit in which cross sections of all of the cones are rotated into the same plane.
Figure 3B:
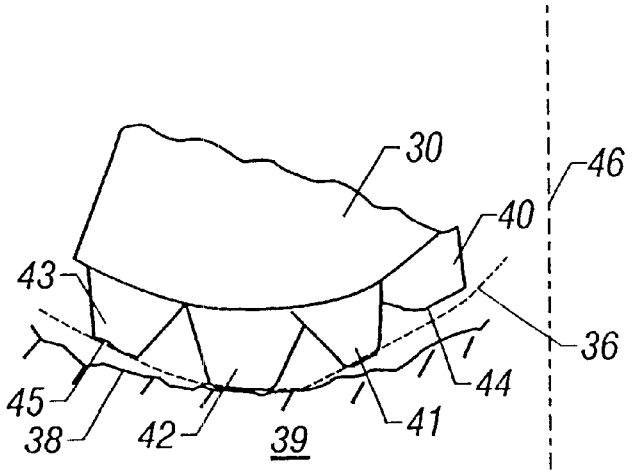
FIG. 3B Prior Art
FIG. 3B shows a cross sectional view of a prior art roller cone bit in contact with a formation in which cross sections of all of the cones are rotated into the same plane.
Figure 4B:
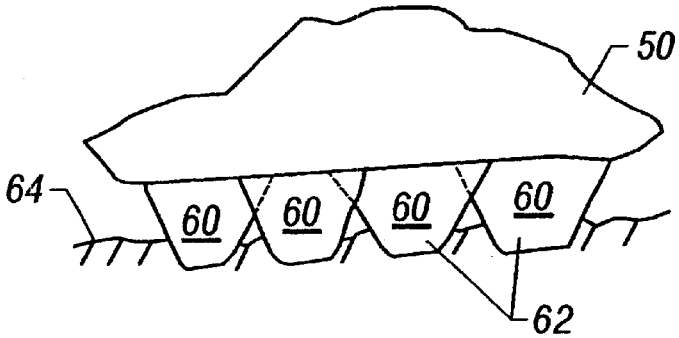
FIG. 4B shows a cross sectional view of an embodiment of the invention in contact with a formation in which cross sections of all of the cones are rotated into the same plane.

The cutting element 62 arrangement shown in FIGS. 4A and 4B is advantageous as compared to a cutting element arrangement such as that shown in prior art FIGS. 3A and 3B. For example, FIG. 3B shows that once cutting element 42 indents and scrapes the formation, the angular orientation of cutting elements 40, 41, and 43 does not place them in a location proximate the bottom of the wellbore, and the cutting elements 40, 41, and 43 may not efficiently drill the formation. This type of cutting action produces a rounded bottom hole profile 38 and may subject the axially lowest row (e.g., the row containing cutting element 42) to the most wear. Uneven wear on the cutting elements may lead to reduced bit life and a less than optimal rate of penetration ("ROP").

Figure 5A:
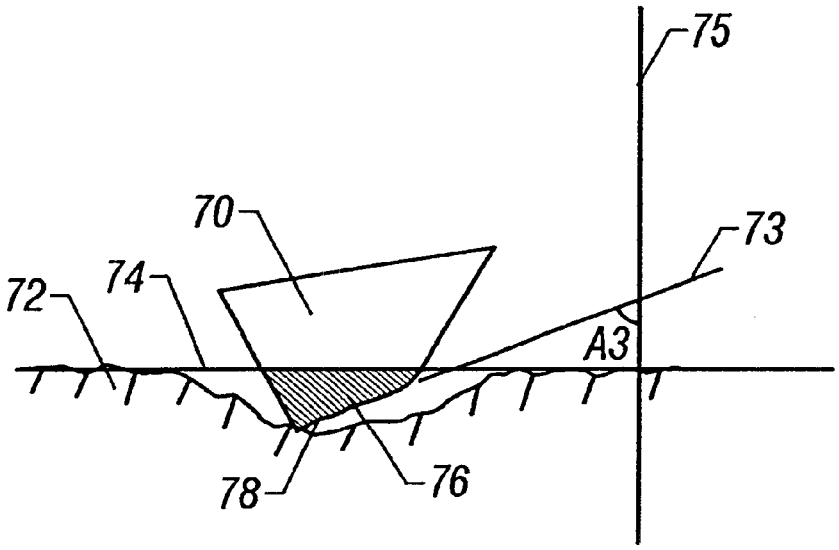
FIG. 5A (Prior Art)
FIG. 5A shows a side view of a prior art cutting element drilling a formation.
Figure 5B:
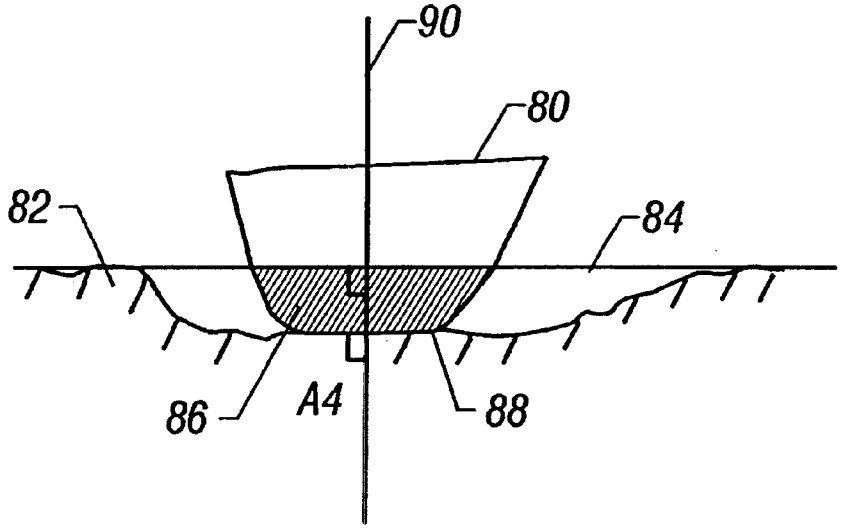
FIG. 5B shows a side view of a cutting element of an embodiment of the invention drilling a formation.

FIGS. 5A and 5B show one possible advantage of having crests (88 in FIG. 5B) that are substantially perpendicular to a bit axis of rotation (56 in FIG. 4A). FIG. 5A shows a cutting element 70 of a prior art bit (such as bit 31 in FIG. 3A) that has a crest 78. An angle formed between a line 73 parallel to the crest 78 and a line 75 parallel to a bit axis of rotation would be substantially less than 90 degrees, as shown by angle A3. The result is that a projected area 76 of cutting and scraping of the cutting element 70 is reduced. The projected area 76 may be defined as the portion of the cutting element 70 that is below a line 74 drawn substantially parallel to the bottom hole profile at a location proximate the cutting element 70. Another definition is that the projected area 76 is defined by the depth of penetration of the cutting element 70 into the formation 72. When the cutting element 70 of FIG. 5A contacts the formation 72, the cutting action of the cutting element 70 is not optimized and wear will be concentrated on the edge of the cutting element 70 that first contacts the formation 72.

FIG. 5B shows a cutting element 80 that has a crest 88 that is substantially perpendicular to a line 90 drawn parallel to a bit axis of rotation and substantially parallel to a line 84 drawn parallel to the bottom hole profile, as is shown by angle A4. The perpendicular crest 88 optimizes a projected area 86 of cutting and scraping of the cutting element 80 and, therefore, optimizes the cutting and scraping action of a drill bit. The distribution of force over the larger scraping area 86 enables the cutting element 80 to produce larger craters in the formation 82 and to more efficiently drill the hole.

In another aspect of the invention, and referring again to FIGS. 4A and 4B, the crests 61 of the cutting elements 62 define a cutting element profile 53 that is substantially flat. The cutting element profile 53, as previously described, is defined as a curve or line that connects corresponding points on the crests 61 of the cutting elements 62 and that defines the relative shape of the bottom of the hole drilled by the cones 50. Only cutting elements 62 or crests 61 that cut the bottom of the wellbore are included when defining the cutting element profile 53. Cutting elements 62 or crests 61 that only scrape the walls of a drilled hole are not included in the profile 53. The cutting element profile 53 may be further defined by angular measurements taken at points (such as points D, E, and F) along the profile 53. Points D, E, and F are located at midpoints of crests 61, and angular measurements are defined relative to a horizontal plane (not shown). In FIG. 4A, point D is located at the midpoint of a gage cutting element and point F is located at the midpoint of a centerline cutting element. In an embodiment of the invention, the angular measurements with respect to the horizontal plane at points D, E, and F are 11.0 degrees, 1.3 degrees, and 10.0 degrees, respectively. In another embodiment of the invention, the angular measurements at points D, E, and F are 5.0 degrees, 0.0 degrees, and 5.0 degrees, respectively. Any smaller angles at points D, E, and F, down to and including zero, are acceptable and are within the scope of the invention. The angles at points D and F need not be the same, but need only in one embodiment be less than about 10 degrees, and more preferably less than about 5 degrees. Moreover, points D, E, and F may be located at equivalent positions on the respective cutting elements and still define the cutting element profile 53 within the scope of the invention.

The substantially flat cutting element profile 53 of the invention enables the bit 54 to drill a hole with a substantially flat bottom. The substantially flat cutting element profile 53 ensures that the cutting elements 62, when located at their downwardmost rotary orientation, have crests 61 that are in substantially uniform contact with the formation. FIG. 4B provides another illustration of the optimized contact between the cutting elements 62 and the formation 64. When contacting the formation 64, the cutting elements 62 act substantially in unison to indent and shear the formation 64 and optimize the performance of the roller cones 50 and the bit (54 in FIG. 4A).

The previously mentioned advantages produce a bit that exhibits relatively even wear characteristics. By having cutting elements in contact with the formation when they are at their downwardmost rotary orientations, the invention ensures that the crests of the cutting elements contact the formation in a substantially uniform manner. The relatively even wear may prolong the life of the bit and help to more efficiently drill the formation.

Those skilled in the art will appreciate that other embodiments of the invention can be devised which do not depart from the spirit of the invention as disclosed herein. Accordingly, the scope of the invention should be limited only by the attached claims.

What is claimed is:

1. A drill bit comprising:

a bit body;

a plurality of roller cones affixed to the bit body and arranged circumferentially about an axis of rotation of the bit; and a plurality of cutting elements disposed on each of the roller cones, arranged such that all the cutting elements on at least one of the roller cones have crests that are within about 10 degrees of perpendicular to the axis of rotation when each crest is in a downwardmost rotary orientation.

2. The bit of claim 1, wherein the cutting elements comprise milled steel teeth.

3. The bit of claim 2, wherein the teeth are coated with a hardfacing material.

4. The bit of claim 1, wherein the cutting elements comprise polycrystalline diamond inserts.

5. The bit of claim 1, wherein the cutting elements comprise boron nitride inserts.

6. The bit of claim 1, wherein the cutting elements comprise tungsten carbide inserts.

7. The bit of claim 6, wherein the tungsten carbide inserts are coated with a superhard material.

8. The bit of claim 1, wherein the cutting elements are arranged in rows located circumferentially about the roller cone.

9. The bit of claim 1, wherein crests on the cutting elements are arranged to define a substantially flat profile.

10. The bit of claim 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 11 degrees.

11. The bit of claim 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 10 degrees.

12. The bit of claim 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 5 degrees.

13. The bit of claim 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 5 degrees.

14. The bit of claim 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 10 degrees.

15. The bit of claims 9, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 5 degrees.

16. The bit of claim 1 wherein Me at least half of the crests are within about 5 degrees of perpendicular to the axis of rotation when each crest is in a downwardmost rotary orientation.

17. The bit of claim 1 wherein the at least half of the crests are substantially perpendicular to the axis of rotation when each crest is in a downwardmost rotary orientation.

18. The bit of claim 1 wherein substantially all the crests are within about 5 degrees of perpendicular to the bit axis.

19. The bit of claim 1 wherein substantially all the crests are substantially perpendicular to the bit axis.

20. A drill bit comprising:

a bit body;

a plurality of roller cones affixed to the bit body and arranged circumferentially about an axis of rotation of the bit; and a plurality of cutting elements disposed on each of the roller cones, wherein the plurality of roller cones and the cutting elements are arranged so that crests on all the cutting elements define a substantially flat profile.

21. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 11.0 degrees.

22. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 10 degrees.

23. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 5 degrees.

24. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 5 degrees.

25. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 10 degrees.

26. The bit of claim 20, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 5 degrees.

27. The bit of claim 20, wherein the cutting elements are arranged in rows located circumferentially about the roller cone.

28. The bit of claim 20, wherein the cutting elements comprise milled steel teeth.

29. The bit of claim 28, wherein the teeth are coated with a hardfacing material.

30. The bit of claim 20, wherein the cutting elements comprise polycrystalline diamond inserts.

31. The bit of claim 20, wherein the cutting elements comprise boron nitride inserts.

32. The bit of claim 20, wherein the cutting elements comprise tungsten carbide inserts.

33. The bit of claim 32, wherein the tungsten carbide inserts are coated with a superhard material.

34. The bit of claim 20, wherein at least half of the cutting elements have crests that are within about 10 degrees of perpendicular to the axis of rotation when each crest of the at least half of the cutting elements is in a downwardmost rotary orientation.

35. The bit of claim 34, wherein at least half of the crests are within about 5 degrees of perpendicularity to the bit axis.

36. The bit of claim 20, wherein substantially all of the cutting elements on at least one of the roller cones have crests that are within about 10 degrees of perpendicular to the axis of rotation when each of the crests is in a downwardmost rotary orientation.

37. The bit of claim 36, wherein substantially all the crests are within about 5 degrees of perpendicularity to the axis of rotation when each of the crests is in a downwardmost rotary orientation.

38. The bit of claim 36, wherein substantially all the crests are substantially perpendicular to the by axis of rotation when each of the crests is in a downwardmost rotary orientation.

39. A drill bit comprising:

a bit body;

a plurality of roller cones affixed to the bit body and arranged circumferentially about an axis of rotation of the bit; and a plurality of cutting elements disposed on each of the roller cones, arranged such that all the cutting elements on at least one of the roller cones have crests that are within about 10 degrees of perpendicular to the axis of rotation when each crest is in a downwardmost rotary orientation, and wherein the plurality of roller cones and the cutting elements are arranged so that the crests on the cutting elements define a substantially flat profile.

40. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 11.0 degrees.

41. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 10 degrees.

42. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the gage cutting element is less than about 5 degrees.

43. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element is less than about 5 degrees.

44. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 10 degrees.

45. The bit of claim 39, wherein the substantially flat profile is defined by a curve that intersects midpoints of the crests at angles measured relative to a horizontal plane, the curve having endpoints located at a midpoint of a gage cutting element and a midpoint of a centerline cutting element, wherein the angle at the centerline cutting element and at the gage cutting element is less than about 5 degrees.

46. The bit of claim 39, wherein the cutting elements are arranged in rows located circumferentially about the roller cone.

47. The bit of claim 39, wherein the cutting elements comprise milled steel teeth.

48. The bit of claim 39, wherein the cutting elements are coated with a hardfacing material.

49. The bit of claim 39, wherein the cutting elements comprise polycrystalline diamond inserts.

50. The bit of claim 39, wherein the cutting elements comprise boron nitride inserts.

51. The bit of claim 39, wherein the cutting elements comprise tungsten carbide inserts.

52. The bit of claim 51, wherein the tungsten carbide inserts are coated with a superhard material.

53. The bit of claim 39, wherein at least half of the crests are within about 5 degrees of perpendicularity to the bit axis.

54. The bit of claim 39, wherein at least half of the crests are substantially perpendicular to the bit axis.

55. The bit of claim 39, wherein substantially all the crests are within about 5 degrees of perpendicularity to the bit axis.

56. The bit of claim 39, wherein substantially all the crests are substantially perpendicular to the bit axis.

* * * * *